US009249610B2

(12) United States Patent
Reus

(10) Patent No.: US 9,249,610 B2
(45) Date of Patent: Feb. 2, 2016

(54) DEVICE FOR AT LEAST PARTIALLY CLOSING OFF A CAVITY THAT IS OPEN AT THE TOP

(75) Inventor: Pierre Reus, Fontenay le Comte (FR)

(73) Assignee: R-PI, Fontenay le Comte (FR)

( * ) Notice: Subject to any disclaimer, the term of this patent is extended or adjusted under 35 U.S.C. 154(b) by 46 days.

(21) Appl. No.: 14/117,187

(22) PCT Filed: May 10, 2012

(86) PCT No.: PCT/FR2012/051035

§ 371 (c)(1),
(2), (4) Date: Nov. 12, 2013

(87) PCT Pub. No.: WO2012/156622

PCT Pub. Date: Nov. 22, 2012

(65) Prior Publication Data

US 2015/0053357 A1 Feb. 26, 2015

(30) Foreign Application Priority Data

May 17, 2011 (FR) ..... 11 54260

(51) Int. Cl.
*E06B 3/48* (2006.01)
*E05D 15/26* (2006.01)
(Continued)

(52) U.S. Cl.
CPC ..... *E05D 15/26* (2013.01); *E04H 4/082* (2013.01); *E04H 4/086* (2013.01); *E05D 15/0652* (2013.01)

(58) Field of Classification Search
CPC ..... E04H 4/088; E06B 9/06; E06B 9/0607; E06B 9/0676; E06B 9/0669; E06B 9/0638; E06B 3/481; E05D 15/262
USPC ..... 160/32, 35, 25, 229.1, 235, 218, 201, 160/206, 36, 213, 187
See application file for complete search history.

(56) References Cited

U.S. PATENT DOCUMENTS 834,287 A * 10/1906 Frey ..... 160/193
1,768,267 A * 6/1930 Phillips ..... 160/115
(Continued)

FOREIGN PATENT DOCUMENTS

EP 1 619 346 A1 1/2006
FR 2 843 152 A1 2/2004
(Continued)

OTHER PUBLICATIONS

Beloou, Philippe. English Translation of "FR2843152". Feb. 6, 2004. Accessed Mar. 18, 2015 <http://worldwide.espacenet.com/publicationDetails/biblio?DB=worldwide.espacenet.com&II=0&ND=3&adjacent=true&locale=en_EP&FT=D&date=20040206&CC=FR&NR=2843152A1&KC=A1>.*
(Continued)

*Primary Examiner* — Katherine Mitchell
*Assistant Examiner* — Johnnie A Shablack
(74) *Attorney, Agent, or Firm* — Young & Thompson

(57) ABSTRACT

The invention relates to a closure device for closing off, at least in part, a cavity (1) that is open at its top, said device comprising a set of panels (3) suitable for forming a closure cover and cover support means (13). In the invention, each panel has link means for linking to the neighboring panel(s) (3) so as to enable said set of panels (3) to go from a stacked configuration, in which they are superposed on one another in order to open up said opening in said cavity (1) at least in part, to a deployed configuration, in which the panels of at least some of said set of panels (3) extend in alignment with one another while bearing against said cover support means (3). Said device further comprises elastically deformable means (4) suitable for being compressed by said panels when said set of panels (3) are in the stacked configuration.

16 Claims, 4 Drawing Sheets

(51) Int. Cl.
*E04H 4/08* (2006.01)
*E05D 15/06* (2006.01)

(56) References Cited

U.S. PATENT DOCUMENTS

| | | | | | |
|---|---|---|---|---|---|
| 1,860,463 | A | * | 5/1932 | Kaplan et al. | 296/219 |
| 2,834,410 | A | * | 5/1958 | Kuyper | 160/183 |
| 2,958,083 | A | * | 11/1960 | Shook et al. | 4/502 |
| 3,127,925 | A | * | 4/1964 | Sjostrom | 160/193 |
| 3,180,302 | A | * | 4/1965 | Hamilton | 114/203 |
| 3,199,576 | A | * | 8/1965 | Jericijo | 160/193 |
| 3,359,594 | A | * | 12/1967 | Pastoor | 16/356 |
| 3,403,720 | A | * | 10/1968 | Ahleen | 160/231.2 |
| 3,411,560 | A | * | 11/1968 | Haury | 160/33 |
| 3,423,121 | A | * | 1/1969 | Lipkin | 296/24.4 |
| 3,446,264 | A | * | 5/1969 | Roemer | 160/188 |
| 3,448,786 | A | * | 6/1969 | Edgerton, Jr. | 160/199 |
| 3,494,408 | A | * | 2/1970 | D'Ercole | 160/206 |
| 3,570,579 | A | * | 3/1971 | Matsushima | 160/235 |
| 3,658,378 | A | * | 4/1972 | Sutren | 296/219 |
| 3,738,413 | A | * | 6/1973 | Frobosilo et al. | 160/35 |
| 3,820,840 | A | * | 6/1974 | Forsberg | 96/100.12 |
| 3,842,891 | A | * | 10/1974 | Kinnroth et al. | 160/35 |
| 3,924,671 | A | * | 12/1975 | Gates | 160/183 |
| 4,038,788 | A | * | 8/1977 | Claessens | 52/2.17 |
| 4,193,439 | A | * | 3/1980 | Kummerman | 160/188 |
| 4,303,117 | A | * | 12/1981 | Lindbergh | 160/189 |
| 4,341,253 | A | * | 7/1982 | Eyerle | 160/133 |
| 4,350,199 | A | * | 9/1982 | Pino | 160/201 |
| 4,374,537 | A | * | 2/1983 | Lindbergh | 160/189 |
| 4,460,030 | A | * | 7/1984 | Tsunemura et al. | 160/35 |
| 4,603,723 | A | * | 8/1986 | Sugihara | 160/35 |
| 4,610,289 | A | * | 9/1986 | Sugihara | 160/35 |
| 4,747,441 | A | * | 5/1988 | Apolzer et al. | 160/206 |
| 4,867,220 | A | * | 9/1989 | Matsumoto et al. | 160/35 |
| 5,011,214 | A | * | 4/1991 | Friesen et al. | 296/100.09 |
| 5,109,911 | A | * | 5/1992 | Bockisch | 160/199 |
| 5,738,160 | A | * | 4/1998 | Rice | 160/84.06 |
| 5,947,178 | A | * | 9/1999 | Patten | 160/193 |
| 6,321,819 | B1 | * | 11/2001 | Copp et al. | 160/35 |
| 6,422,635 | B1 | * | 7/2002 | Steffens et al. | 296/100.09 |
| 6,478,204 | B2 | * | 11/2002 | Lange et al. | 224/539 |
| 6,843,019 | B2 | * | 1/2005 | Mercurio et al. | 47/17 |
| 7,089,989 | B2 | * | 8/2006 | Pfender | 160/195 |
| 7,097,228 | B1 | * | 8/2006 | Norgard | 296/100.05 |
| 7,484,788 | B2 | * | 2/2009 | Calder et al. | 296/100.09 |
| 7,540,391 | B2 | * | 6/2009 | Kato | 220/252 |
| 7,735,538 | B2 | * | 6/2010 | Ogawa | 160/230 |
| 7,871,225 | B2 | * | 1/2011 | Prust et al. | 409/134 |
| 8,191,603 | B1 | * | 6/2012 | Motosko | 160/235 |
| 8,371,356 | B2 | * | 2/2013 | Manser | 160/201 |
| 8,376,436 | B2 | * | 2/2013 | Nakamura et al. | 296/24.34 |
| 8,567,591 | B2 | * | 10/2013 | Gonzalez Alemany et al. | 198/600 |
| 2004/0226668 | A1 | * | 11/2004 | Biggers | 160/183 |
| 2011/0225902 | A1 | | 9/2011 | Pouthe et al. | |
| 2011/0253322 | A1 | * | 10/2011 | Fanizzi | 160/188 |
| 2013/0292067 | A1 | * | 11/2013 | Lucas | 160/213 |
| 2014/0007530 | A1 | * | 1/2014 | Liao | 52/220.7 |
| 2015/0053357 | A1 | * | 2/2015 | Reus | 160/201 |

FOREIGN PATENT DOCUMENTS

| | | | |
|---|---|---|---|
| GB | 2 060 754 | A | 5/1981 |
| WO | 2010/063912 | A1 | 6/2010 |

OTHER PUBLICATIONS

International Search Report, dated Jul. 26, 2012, from corresponding PCT application.

* cited by examiner

DEVICE FOR AT LEAST PARTIALLY CLOSING OFF A CAVITY THAT IS OPEN AT THE TOP

BACKGROUND OF THE INVENTION

1. Field of the Invention

The present invention relates to a closure device for closing off, at least in part, a cavity of the pit or pool type that is open at its top, in particular for preventing falling into said cavity.

The invention relates more particularly to a closure device for closing off, at least in part, a cavity that is open at its top, said device comprising a set of panels suitable for forming a closure cover for closing off said cavity and cover support means making it possible to support said panels when said panels are deployed to form said closure cover.

The invention also provides an installation, in particular a vehicle repair installation, of the type comprising at least a cavity and a closure device of the above-mentioned type for closing off the opening of the cavity.

2. Description of the Related Art

Devices designed to close off inspection or work pits of the type used by mechanics for repairing vehicles while such pits are not being used are well known to persons skilled in the art.

Such a pit is formed by a cavity in the general shape of a rectangular trough that is sunk into the floor and that is of width less than the widths of the vehicles to be repaired, so that said vehicles can be positioned over the pit along its longitudinal axis. While they are not being used, and for evident safety reasons, the openings of such pits should be closed off. This is usually achieved by laying a series of panels, planks, or transverse beams across said pits, with the respective edge faces of the panels, planks, or beams being applied against one another so as to form a continuous cover surface over the entire length of the pit.

Putting such panels in place is tedious and unreliable. Starting from a stack of panels to be positioned, operators must adapt their working positions for each panel to be handled because the height of the stack decreases as the operator positions the panels along the opening of the pit. Operators must therefore stoop lower and lower in order to take hold of the panels with a view to positioning them along the opening or, conversely, stand up straighter and straighter in order to stack up the panels during an operation for uncovering the opening of the pit. In addition, the operator must move along the opening in order to position said panels. Such a solution therefore does not make it possible to close off and to open up the opening of the pit rapidly with a limited number of handling operations. Also, such solution does not make it possible to guarantee that said panels are put into place correctly.

Thus, with such a solution, operators must be continually changing their working positions, which is tedious and tiresome. In particular, such a solution does not enable the operator to maintain a given working position for stacking up and deploying said panels with a minimum amount of effort.

Closure devices are also known from the state of the art that are configured to enable that type of pit to be closed and opened automatically or semi-automatically. In particular, devices exist that comprise a metal curtain system mounted to slide in longitudinal rails and driven by motor-driven mechanisms.

By making provision for such closure devices to be motor-driven, the operations for closing off and for opening up the cavity can be made simple and effortless, but it has been observed that such a sliding metal curtain system associated with motor drive means is costly and unreliable, in particular for a metal curtain that is long. The motor drive of a long sliding curtain is subjected to major friction forces that are often accompanied by interfering forces caused by the imperfections of the device. Such a device equipped with a motor drive then might jam and become damaged.

BRIEF SUMMARY OF THE INVENTION

An object of the present invention is to propose a closure device that is of design making it possible to close off and to uncover the opening of the cavity in simple manner, with a limited number of handling operations for the operator, and without the operator having to make efforts that are too great for closing off or opening up the opening of the pit.

Another object of the invention is to propose a closure device that is of design making it possible to close off and to open up the opening of the cavity without requiring motor drive, and for which the forces necessary for handling the closure means are reduced.

In particular, an object of the invention is to enable the operator to deploy and to retract the closure means of the closure device while staying in the same working position and while limiting the efforts to be made during each of the deployment and retraction operations.

To this end, the invention provides a closure device for closing off, at least in part, a cavity that is open at its top, said device comprising a set of panels suitable for forming a closure cover for closing off said cavity at least in part and cover support means making it possible to support said panels when said panels are deployed to form said closure cover;

said closure device being characterized in that each panel has link means for linking to the neighboring panel(s) so as to enable said set of panels to go from a stacked configuration, in which they are superposed on one another in order to open up said opening in said cavity at least in part, to a deployed configuration, in which the panels of at least some fraction of said set of panels extend in alignment with one another while bearing against said cover support means in order to form said closure cover, and vice versa;

and in that said closure device further comprises elastically deformable means suitable for being compressed by said panels when said set of panels are in the stacked configuration.

Said elastically deformable means make it possible to adjust the position of the stack of panels as a function of whether at least some of said panels are in the stacked configuration or in the deployed configuration. The closure device and, in particular, said elastically deformable means, are designed to be received inside the cavity. When a panel is taken from the stack, said elastically deformable means are subjected to less compression, thereby causing the stack to rise and thus making it possible to bring the panel at the top of the stack closer to the opening of the cavity and thus closer to the operator, said panel at the top of the stack corresponding to the panel that was previously situated under the panel that has just been taken from the stack. Raising the stack thus makes it possible to compensate, at least in part, for the reduction in the height of the stack that results from a panel being removed from it. Conversely, when a panel is put back onto the stack in order to uncover the opening of the cavity, the elastically deformable means are compressed to a greater extent, thereby causing the panel that has just been stacked to be moved down through a certain height, this height by which the panel moves down being compensated at least in part by the height corresponding to the thickness of the panel, thereby enabling operators to avoid having to change their working positions to any large extent.

When it is stated that a panel is taken or removed from the stack, said panel naturally remains linked via its link means to the neighboring panels, in particular to the neighboring panel that then forms the top of the stack. Said panel is considered as being taken, removed or deployed, when its weight is supported by the operator or by the cover support means, i.e. when its weight is no longer supported by said elastically deformable means. Conversely, when a panel is put back on the stack, its weight is supported by the elastically deformable means, via a support tray as described in detail below, and no longer by said cover support means. Said elastically deformable means are positioned in register with and below the location occupied by the panels in the stacked state.

According to an advantageous characteristic of the invention, the stiffness of said elastically deformable means is chosen as a function of the thickness and of the weight of the panels, in such a manner that the top of the stack of panels, or the top of the panel, that exerts a bearing force on the elastically deformable means is situated at a substantially constant height both when said panels are in the stacked configuration and also when at least some of the panels are in the deployed configuration, i.e. when the weight of said at least some of the panels is supported by said cover support means.

Said elastically deformable means thus make it possible to maintain the top of the stack at a substantially constant level, thereby facilitating the operations of closing off and of opening up the opening of the cavity for the operator. The top of the stack corresponds to the top panel of the stack that the operator must take hold of in order to deploy the panels over said cover support means with a view to closing off the opening in the pit at least in part, or, conversely, to the top panel of the stack on which the operator is to stack the panels of the cover for opening up the opening of the pit at least in part.

Thus, the operator who wishes to close off the opening in the pit at least in part, can take hold of the top panel of the stack and, by means of its link means for linking it to the other panels, can bring it onto the cover support means. Since the weight of the panel taken from the stack is supported by the cover support means, the stack of panels is lightened by the weight of a panel so that, by equilibrium between the return force of the elastically deformable means and the remaining weight of the stack, the elastically deformable means cause the stack to rise by a height corresponding to the thickness of the panel taken from the stack. Thus, the top of the stack is maintained at a substantially constant height, preferably close to the height or to the level of the support means, which are themselves advantageously situated in the vicinity of the opening plane of the cavity, so that the panel that forms the top of the stack may be readily taken from the stack and brought onto said cover support means in order to increase the length of cover that is resting on said cover support means.

By means of such a choice of stiffness for the elastically deformable means, the elastically deformable means settle under the weight of the stack of panels over a height corresponding to the height of the stack. When, starting from a stacked configuration of the set of panels, in which configuration the elastically deformable means are strongly compressed, the operator unstacks some fraction of the set of panels to form a closure cover bearing against the cover support means, the elastically deformable means move up through a distance corresponding to the total thickness of the unstacked panels, the weight of which is supported by said longitudinal support means rather than by the elastically deformable means. Conversely, when, starting from an unstacked configuration in which at least some fraction of the set of panels is unstacked and the elastically deformed means are compressed to a small extent compared with when the panels are in the stacked configuration, the operator stacks up the panels on one another again, the elastically deformable means are compressed over a distance corresponding to the total thickness of the stacked-up panels, the weight of which is, once again, supported by the elastically deformable means and no longer by said longitudinal support means.

In other words, the deformation step-size of the elastically deformable means, which step-size corresponds to the relaxation or compression stroke of said elastically deformable means while a panel is going from the state bearing against said elastically deformable means to the state bearing against the cover support means, or vice versa, is substantially equal to the thickness of the panel.

Since the top of the stack is thus situated substantially at the same level as the number of panels taken from the stack to form the closure cover, the operator can easily stack up or deploy the panels without the level of the top of the stack increasing or decreasing, thereby enabling the operator to remain substantially in the same working position throughout each of the operations for closing off and for uncovering the top opening of the cavity. Maintaining the top of the stack at a substantially constant level in this way, in particular in the vicinity of the cover support means, also makes it possible to limit the interference effects that might appear while the panels of the cover of panels are moving along the longitudinal support means during the operation for deploying the panels or during the operation for stacking up said panels.

Such a design for the closure device that is formed of a set of panels that are hinged together to make it possible to form a closure cover or a stack, and that is associated with a system for maintaining the top of the stack at a substantially constant level, makes it possible to omit any complex motor-driven means for driving the closure elements.

According to an advantageous characteristic of the invention, said panels are of substantially the same thickness and of substantially the same weight from one panel to another.

In other words, each panel of said set of panels has a thickness and a weight substantially equal to the thickness and to the weight of each of the other panels of said set of panels.

Advantageously, the elastically deformable means have stiffness, expressed in decanewtons per millimeter (daN/mm), that is substantially equal to the weight of a panel, expressed in kilograms (kg), divided by its thickness, expressed in millimeters (mm).

Thus, when a panel is taken from the stack, and by means of the lightening of the weight of the stack, the elastically deformable means and thus the stack are caused to rise by a height corresponding to the thickness of the taken panel, so that the top of the stack remains at the same level. Thus, when a panel is put back onto the stack, and by means of the weight of the added panel, the elastically deformable means and thus the stack move down through a height corresponding to the thickness of the added panel, so that the top of the stack remains at the same level.

According to an advantageous characteristic of the invention, said link means of the panels are configured to enable the panels to be folded concertina-fashion.

Since the panels have such a capacity for being folded concertina-fashion, they are easy to stack up and to deploy.

According to an advantageous characteristic of the invention, at least some of the panels are provided with roll and/or slide means suitable for coming to roll and/or to slide on said cover support means, such as rails, provided on or in the vicinities of two opposite side walls of the cavity.

Said operator can thus take up a position on the edge of the cavity, substantially in register with the zone of the cavity that receives the panels when said panels are in the stacked configuration, and, for closing off the top opening of the cavity at least in part, said operator can take hold of the panel on the top of the stack and bring it into or onto said cover support means. While remaining in the same working position, the operator can take hold of the next panel that forms the top of the stack in order to bring it into or onto said cover support means, thereby pushing the preceding deployed panel along said cover support means by rolling and/or sliding.

Advantageously, on each side edge of each of said panels equipped with roll and/or slide means, said roll and/or slide means comprise two roll and/or slide members, each of which is spaced apart from that one of the end edges of the panel that is closer to said member by a distance different from the distance between the other roll and/or slide member and that one of the end edges of the panel that is closer to said other member. Said edges of each panel may also be referred to as "edge faces".

Preferably, said link means of at least each of the panels that are situated between two other panels, comprise two hinge elements, one of which equips a "front" edge of the panel and the other of which equips the "rear" opposite edge of said panel, and the two hinge elements of said panel are distributed on either side of the mean plane of the panel.

Distributing the two hinge elements of said panel on either side of the mean plane of the panel makes it possible to stack up said panels on one another concertina-fashion, without having to space the hinge axis too far apart from the edges of the panels equipped in this way in order to allow a panel to pivot relative to a neighboring panel. Spacing the link axis too far away would leave a large gap between the panels in the deployed configuration, which would be dangerous for the operator who might walk on the cover of panels.

According to an advantageous characteristic of the invention, said device includes guide means making it possible to guide the elastically deformable return means as they deform.

According to an advantageous characteristic of the invention, said device further comprises a support tray suitable for supporting the set of panels when said panels are in the stacked state, said support plate being coupled to the elastically deformable means.

Said support tray offers a bearing surface for the stack of panels that makes it possible to maintain each panel substantially horizontal, i.e. substantially parallel to the opening in the cavity. Said tray extends substantially horizontally.

According to an advantageous characteristic of the invention, said support tray is provided with link means, which are preferably hinge means, making it possible to link together said support tray and the panel that forms the bottom of the stack of panels;

and said support tray also has a support zone that projects from the tray over a height substantially equal to the height to which the link means equipping the support tray project, in such a manner as to maintain the panel at the bottom of the stack of panels substantially parallel to the support tray.

The invention also provides an installation including a cavity, preferably of the pit type, and a closure device as described above, said installation being characterized in that said cover support means extend, at least in part, substantially horizontally, on or in the vicinities of two opposite side walls of the cavity, and preferably on or in the vicinities of their free edges, that define the opening of the cavity. Said cover support means are suitable for supporting and guiding at least some of the panels of the set of panels while said panels are being deployed along said cover support means.

According to an advantageous characteristic of the invention, said cover support means comprise at least two rails fastened to or in the vicinities of said opposite side walls of the cavity, preferably parallel and in the vicinities of the free edges of said opposite side walls, while extending facing each other, substantially horizontally, and on which rails the panels of at least a fraction of the set of panels are suitable for resting via their side edges when in the deployed configuration.

According to an advantageous characteristic of the invention, said closure device is received at least in part, and preferably entirely, inside the cavity, and preferably in the vicinity of an end wall of the cavity that interconnects said opposite side walls of the cavity.

The elastically deformable means are situated in the cavity. Preferably, at least when the panels are in the stacked configuration, the stack of panels of the closure device is received inside the cavity.

BRIEF DESCRIPTION OF THE DRAWINGS

The invention can be well understood on reading the following description of embodiments given with reference to the accompanying drawings, in which.

DETAILED DESCRIPTION OF THE PREFERRED EMBODIMENTS

Figure 1:
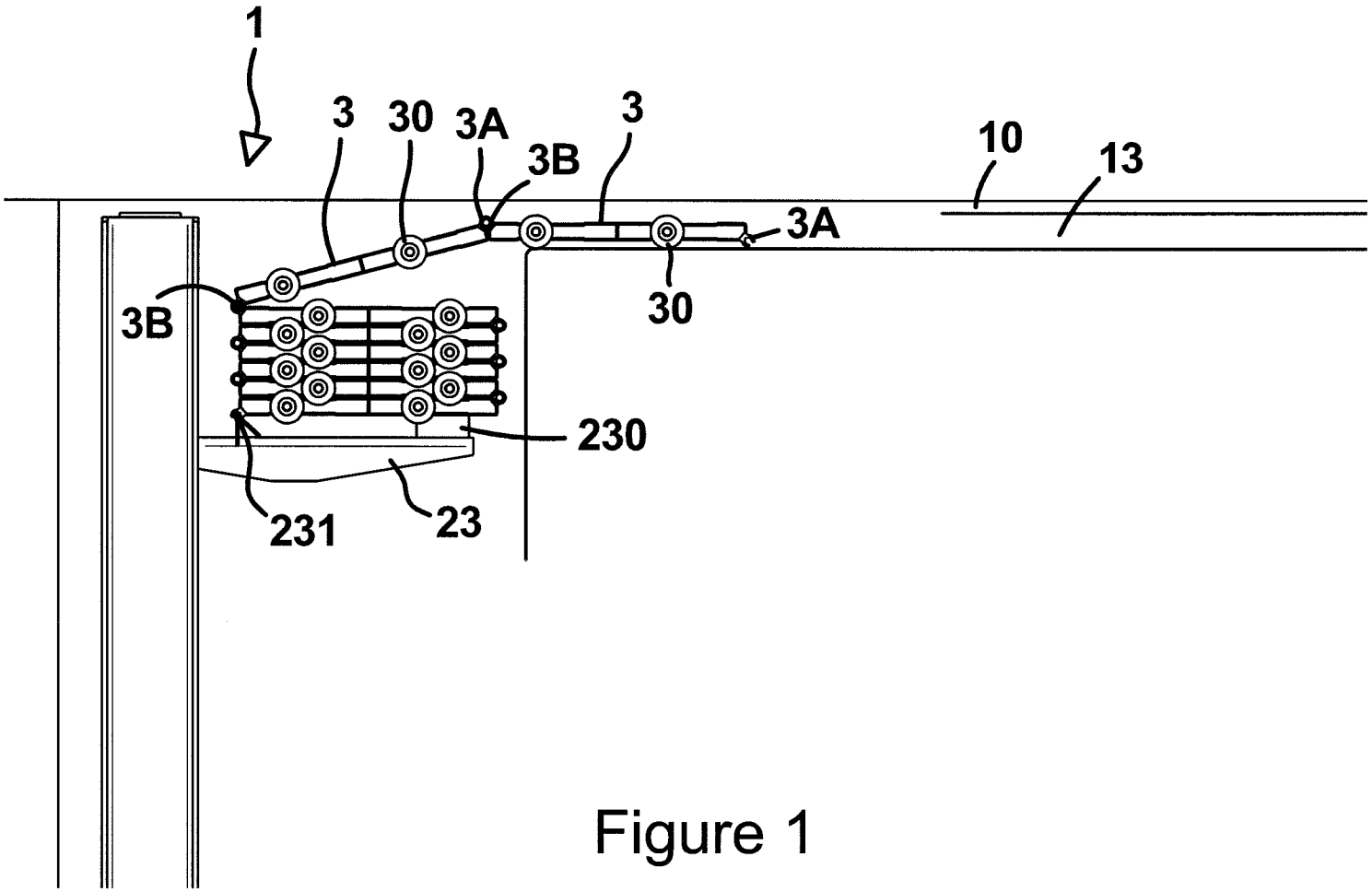
FIG. 1 is a diagrammatic longitudinal section view of a pit equipped with a closure device of the invention at the start of the panel deployment operation for deploying the panels for the purpose of closing off the pit.

With reference to the figures and as indicated above, the invention relates to a closure device for closing off, at least in part, a cavity 1 that is open at its top.

In the examples shown, said cavity is formed by a workshop pit that is in the form of a sunken cavity that is in the general shape of a rectangular trough and that is defined by two side edges 100 and by two end edges 110. The side edges 100 and the end edges 110 correspond respectively to the free edges of the side walls 10 and to the end walls 11 of the cavity. The end edges 110 are generally provided with stairs for giving access to the inside of the pit.

In equivalent manner, the device could be applied to a pool, e.g. to a swimming pool or a pool of some other type.

Said closure device comprises a set of panels 3 suitable for forming a cover making it possible to close off the opening of the cavity at least in part, and cover support means 13 designed to be positioned on or in the vicinities of the top edges 100 of the two opposite side walls 10 of the cavity 1 so as to make it possible to support and preferably to guide said panels when they are deployed to form said cover. The cover of panels is designed to extend, when in the deployed state, from or in the vicinity of an end wall towards the other end wall of the cavity 1, along the side walls of the cavity and between said side walls in such a manner as to close off the top opening of the cavity at least in part. Said panels or "slabs" may be made of aluminum.

The purpose of such a cover device is to avoid anything or anyone falling into the cavity, in particular during periods for which the cavity is not being used, and to be able to use the panels that form the closure cover as a load-bearing floor.

Figure 3:
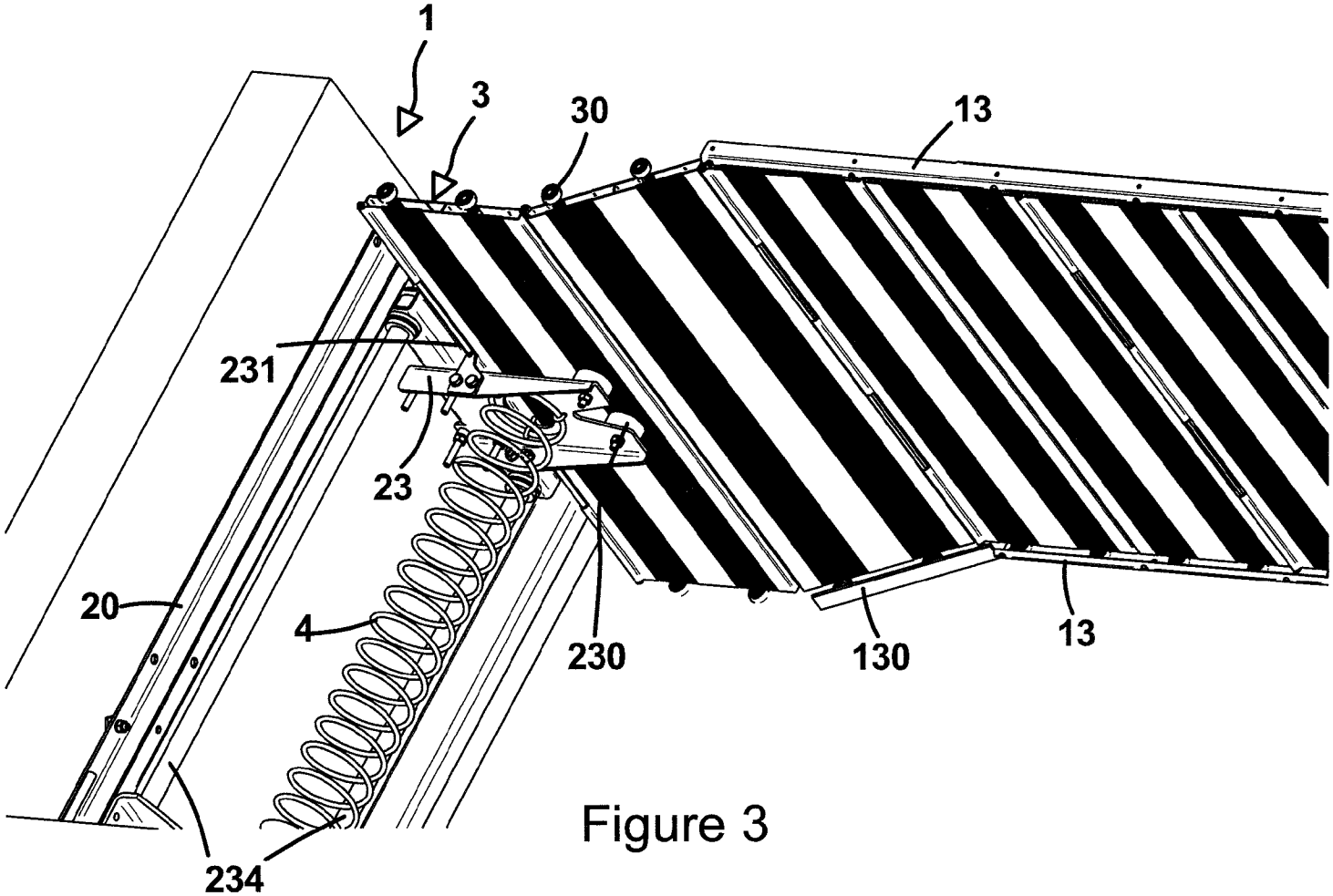
FIG. 3 is a perspective view from below of the closure device inside the pit of FIG. 1.
Figure 4:
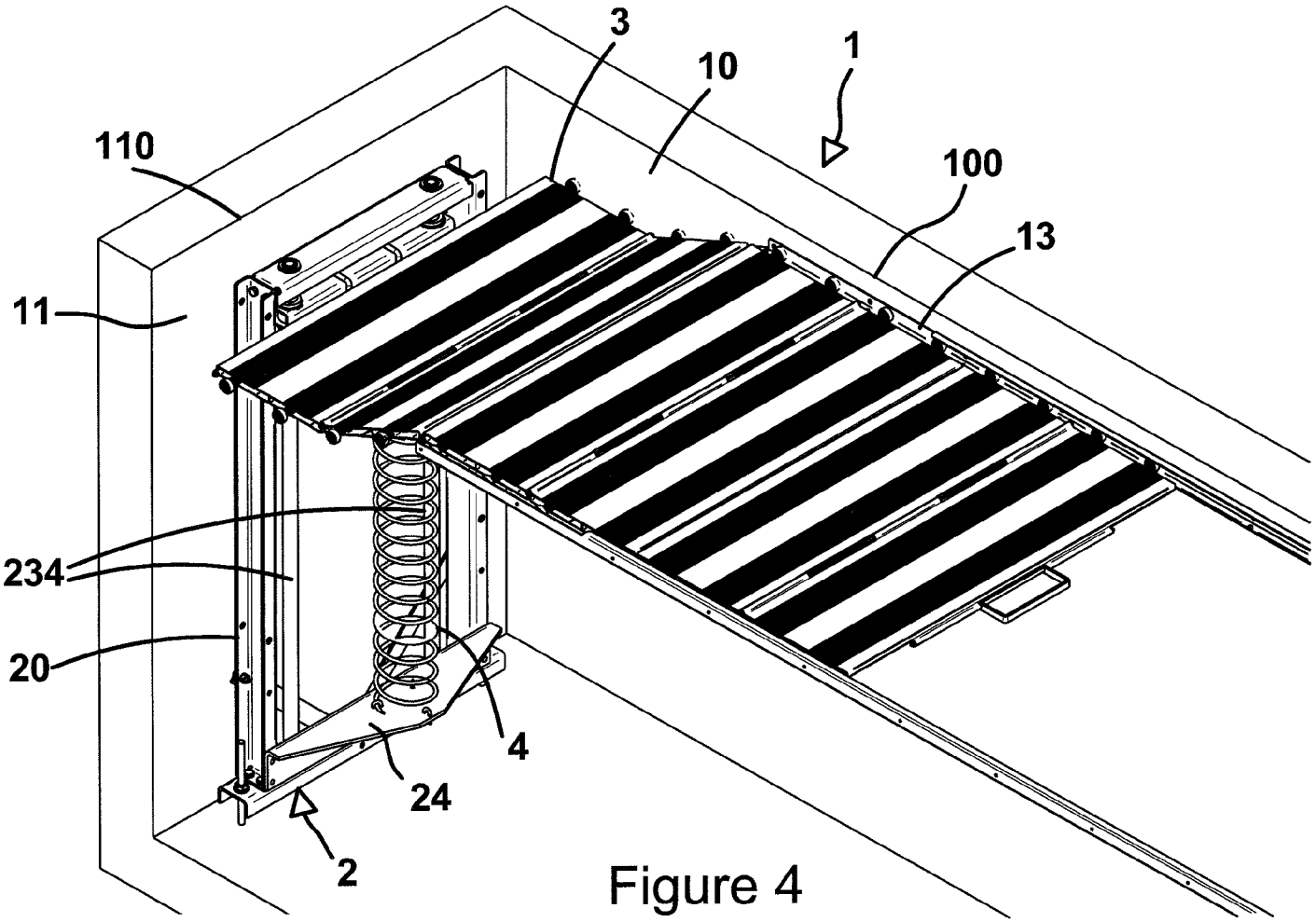
FIG. 4 is a perspective view from above of the closure device inside the pit of FIG. 1.

As described in detail below, said cover support means 13 extend at least in part substantially parallel to the top edges 100 of said side walls 10 that co-operate with each other and with the opposite end walls 11 that interconnect said side walls 10 to define said top opening of the cavity. Generally, the cavity is of elongate shape so that the opposite side walls 10 extend along the longitudinal axis and thus form the longitudinal walls of the cavity. As shown in FIG. 3, it is possible to make provision for a portion of the end of said cover support means 13 to be inclined to form a ramp 130 making it possible to facilitate deployment of the panels over the cover support means 13. Thus, the panel taken from the stack can be brought onto the ramp 130 and then pushed to reach the horizontal remaining portion of the cover support means. Also, in the opposite direction, the ramp facilitates bringing the panels back onto the stack.

In a manner characteristic of the invention, each panel has link means 3A, 3B for linking them to the neighboring panels 3 in order to enable said set of panels 3 to go from a stacked configuration in which they are superposed on each other so as to open up the opening in said cavity 1 at least in part to a deployed configuration in which the panels of at least some of said set of panels 3 extend in alignment with one another while bearing on said cover support means 13 in order to form a cover suitable for closing off said opening in the cavity 1 in part, and vice versa.

While at least some of the panels 3 are being deployed from the stack, the panels that are taken from the stack to form a closure cover bearing along the cover support means 13, remain connected to the other panels or to the last panel in the stack via their link means 3A, 3B.

Said closure device includes elastically deformable means 4 that are compressed by said panels when said set of panels 3 are in the stacked configuration. As described in detail below, said elastically deformable means are also compressed, but to a lesser extent, when the panels are in the deployed configuration because the support tray 23 for supporting the stack remains bearing against the elastically deformable means 4. It is also possible to make provision for the panel at the bottom of the stack to remain bearing at least in part on said support tray to which it is linked as described in detail below. Said elastically deformable means 4 extend vertically, i.e. substantially orthogonally to the bottom wall of the cavity. Said elastically deformable means 4 deform vertically as a function of the weight of the stack of panels.

Said elastically deformable means 4 are formed by one or more springs that are driven in compression by the weight of the panels as a function of whether said panels are in the stacked configuration or in the deployed position.

The stiffness of said elastically deformable means 4 corresponds to the ratio between the variation in force (the variation in weight in this example) to which said elastically deformable means are subjected and the corresponding deformation of said elastically deformable means. The stiffness of said elastically deformable means 4 is chosen as a function of the thickness and of the weight of the panels 3, so that the top of the stack of panels, or the top of the panel (when all of the other panels are deployed), that exerts a bearing force on the elastically deformable means 4 is situated at a height that is substantially constant both when said panels are in the stacked configuration and also when at least some of the panels are in the deployed configuration when the weight of said deployed panels is supported by said cover support means 13.

The elastically deformable means 4 have stiffness that is substantially equal to the weight of a panel 3 divided by its thickness.

The stiffness of the elastically deformable means, formed by a helical spring in the example shown in the figures, is expressed in daN/mm. The stiffness is chosen to be substantially equal to the ratio of the weight of a panel divided by its thickness. By way of example, if each panel weighs 4 kg and measures 20 mm in thickness, the spring that the elastically deformable means forms should have stiffness of 4/20=0.2 daN/mm so that if 5 panels are stacked, the weight of the stack is 20 kg and the spring is compressed by 20/0.2=100 mm, which corresponds to the total thickness of all five panels.

Said elastically deformable means 4 are deformed as a function of the compression force to which they are subjected in substantially linear manner for a range of force varying from a minimum value corresponding to all of the panels being fully unstacked from the stack, to a maximum value corresponding to a configuration in which all of the panels are stacked up on one another and bear against the elastically deformable means 4 via the support tray 23.

When the panels are in the deployed configuration, the support plate 23, and thus said elastically deformable means 4, still bear the weight of the panel at the bottom of the stack, but the weight of the other panels is supported by the cover support means 13 along which said panels are deployed in alignment with one another.

Such a closure device equipped with elastically deformable means, combined with a stack of linked-together panels, thus makes it possible to keep the top face of the stack at a constant level close to the opening to be closed off, in particular close to the cover support means 13, in such a manner as to facilitate firstly taking hold of the panels to be deployed along the opening and secondly stacking said panels concertina-fashion in order to open up said opening in the cavity. Thus, the panels can be deployed or stacked under conditions that are similar in terms of disposition and of weight of each of the panels to be handled, at any time during the operation.

Said elastically deformable means thus form elastically deformable return means 4 making it possible to urge the top of the stack of panels to return to a given level.

Preferably, as shown in the figures, the closure device, and in particular said elastically deformable means, are situated inside the cavity, in the vicinity of or against an end wall 11 of the cavity. In the example shown in the figures, said closure device includes a frame 20 that is described in detail below and that forms a magazine for storing the stack of panels. Said frame 20 stands on the bottom wall of the cavity. Said frame 20 is advantageously fastened to the end wall against or in the vicinity of which it extends.

Said support means 13 make it possible to position the panels forming the closure cover in or close to the cavity 1, preferably along the top edges of the two opposite side walls that define the opening in said cavity 1.

The support means 13 extend substantially horizontally and substantially parallel and, preferably, in the vicinities of the top edges of the two opposite side walls of the cavity 1 along which side walls the cover of panels is designed to be deployed in order to close off the top opening of the cavity at least in part.

In the example shown in the figures, said support means 13 comprise at least two rails fastened to said opposite side walls 10 of the cavity while extending facing each other, substantially horizontally and on which, or inside which the panels 3 of at least a fraction of the set of panels are suitable for resting via their side edges when in the deployed configuration. Said opposite side walls 10 of the cavity on which the rails are provided are the walls that extend in mean planes that are parallel to the longitudinal axis of the cover of panels when said panels are in the unstacked state.

Generally, the cover of panels that is designed to close off the opening of the cavity at least in part extends in the opening plane of said cavity, either slightly above or slightly below said plane. When it extends below said opening plane of the cavity, it is disposed inside the cavity, as it is when it extends in said opening plane. When it is disposed above the opening plane of the cavity, it is, for example, positioned along a longitudinal edge of the cavity or in the middle of the cavity and it closes off the cavity by covering over its opening.

In the example shown in the figures, said return means 4 are formed by a spring that has two opposite ends, an "upper" end of which is situated at the same end as the panels. In particular, said upper end is equipped with a support plate 23 suitable for supporting the stack of panels 3. The "lower" other end is stationary relative to the cavity 1. In particular, in the example shown in the figures, said lower end is attached to a stationary base element 24 of a frame 20 situated inside the cavity. Advantageously, as indicated above, said frame is fastened inside the cavity. Said frame forms a magazine for the panels, i.e. a structure for storing the panels.

Said device includes guide means 234 making it possible to guide the elastically deformable return means 4 as they deform.

Said guide means comprise at least one column 234, and preferably two parallel columns 234, along which said support tray 23 for supporting the stack of panels is mounted to slide. Said columns are secured to the frame 20 and extend substantially vertically. Said support tray is connected via its bottom face, opposite from its top face that faces towards the stack of panels, at the upper end of said elastically deformable return means 4.

The hinge means 3A, 3B via which the panels are hinged together are configured in such a manner as to enable said set of panels to go from the stacked position to the deployed position, or vice versa, by unstacking the panels from the stack or by stacking them back up concertina-fashion. For causing the panels that are to be stacked to go into the stacked configuration by them being folded concertina-fashion, said panels to be stacked are pivoted in alternate directions relative to the panels on which they are superposed.

Each panel 3 has two opposite edges that are referred to as the "front" edge and the "rear" edge and that are interconnected via two side edges. The hinge means 30 of at least each of the panels 3 situated between two other panels comprise at least two hinge elements 3A, 3B, one disposed on the or in the vicinity of the front edge of the panel and the other disposed on the or in the vicinity of the opposite rear edge of the panel. Each hinge element 3A, 3B of a panel is suitable for co-operating with a hinge element 3B, 3A of another panel. The two hinge elements 3A, 3B of each of said panels are distributed on either side of the mean plane of the panel 3.

In other words, one of the hinge elements 3A, 3B extends on the same side as one face of the panel, projecting at least in part from said face, and the other hinge element 3B extends on the same said as the opposite face of said panel, projecting at least in part from said opposite face. Each of the hinge elements 3A, 3B also projects relative to the front edge or to the rear edge of the panel 3 that it equips.

Each hinge element 3A, 3B is an element of the hinge type suitable for co-operating with another hinge element 3B, 3A for forming a hinge link. The panels can pivot relative to each other by means of said hinge links and can thus be folded up on one another concertina-fashion to form a stack of panels. Retracting the cover of panels by stacking them up on one another, merely by folding them up concertina-fashion, is an operation that is easy and quick to perform and that requires little effort for the operator, in particular since the top of the stack onto which the operator is to fold up a panel stays at a constant height during the stacking by means of the elastically deformable return means. In addition, forming such a stack of panels makes it possible to improve the compactness of said panels when the opening in the cavity is in the uncovered state, in particular when the stack extends inside the cavity flush with or under the opening plane of the cavity.

At least some of said panels 3 are also provided with roll and/or slide means 30 suitable for rolling and/or sliding on or in said cover support rails 13 provided on or in the vicinities of the two opposite side walls of the cavity 1. In the example shown in the figures, each of the panels is equipped with such roll and/or slide means 30. By way of a variant, it is possible to make provision for only the panels that are to come to bear against the cover support means 13 to be equipped with such roll and/or slide means 30.

In the solution as shown in the figures, the roll and/or slide means 30 are formed by wheels that equip each of the side edges of the panels in question. In particular, each side edge of a panel is equipped with two wheels that are spaced apart from each other. Such wheels enable the panels to roll effortlessly in the rails that are preferably fastened along the side walls of the cavity, advantageously in the vicinities of the top edges of said cavity.

In addition, each of the two wheels that equip each side edge of the panel is spaced apart from the closer end edge of the panel by a distance different from the distance between the other wheel and the corresponding end edge of the panel, i.e. the end edge of the panel that is closer to said other wheel. Such a configuration of the wheels enables said wheels not to interfere with one another when the panels are folded up concertina-fashion on one another.

The wheels situated on each of the side edges of a panel have their axes coinciding with the axes of the respective wheels situated on the opposite side edge of said panel.

Each of said rails has a U-shaped or C-shaped cross-section that is open towards the other rail, and into which the roll and/or slide means 30 of the panels can be inserted when said panels are in the deployed configuration.

On its face facing towards the panels 3, said support tray 23 is provided with link means 231, which are preferably hinge means, making it possible to link together said support tray 23 and the panel 3 that forms the bottom of the stack of panels 3. Said link means, which are preferably of the hinge type, make it possible to couple the bottom of the stack of panels to the support tray 23 and to offer a certain degree of freedom to the panel at the bottom of the stack relative to the support tray 23 for supporting the stack. Such freedom may be advantageous when all of the panels are deployed to form the cover of panels, and when the panel at the bottom of the stack needs to be inclined relative to the support tray 23 in order to follow the general line of the cover.

Figure 2:
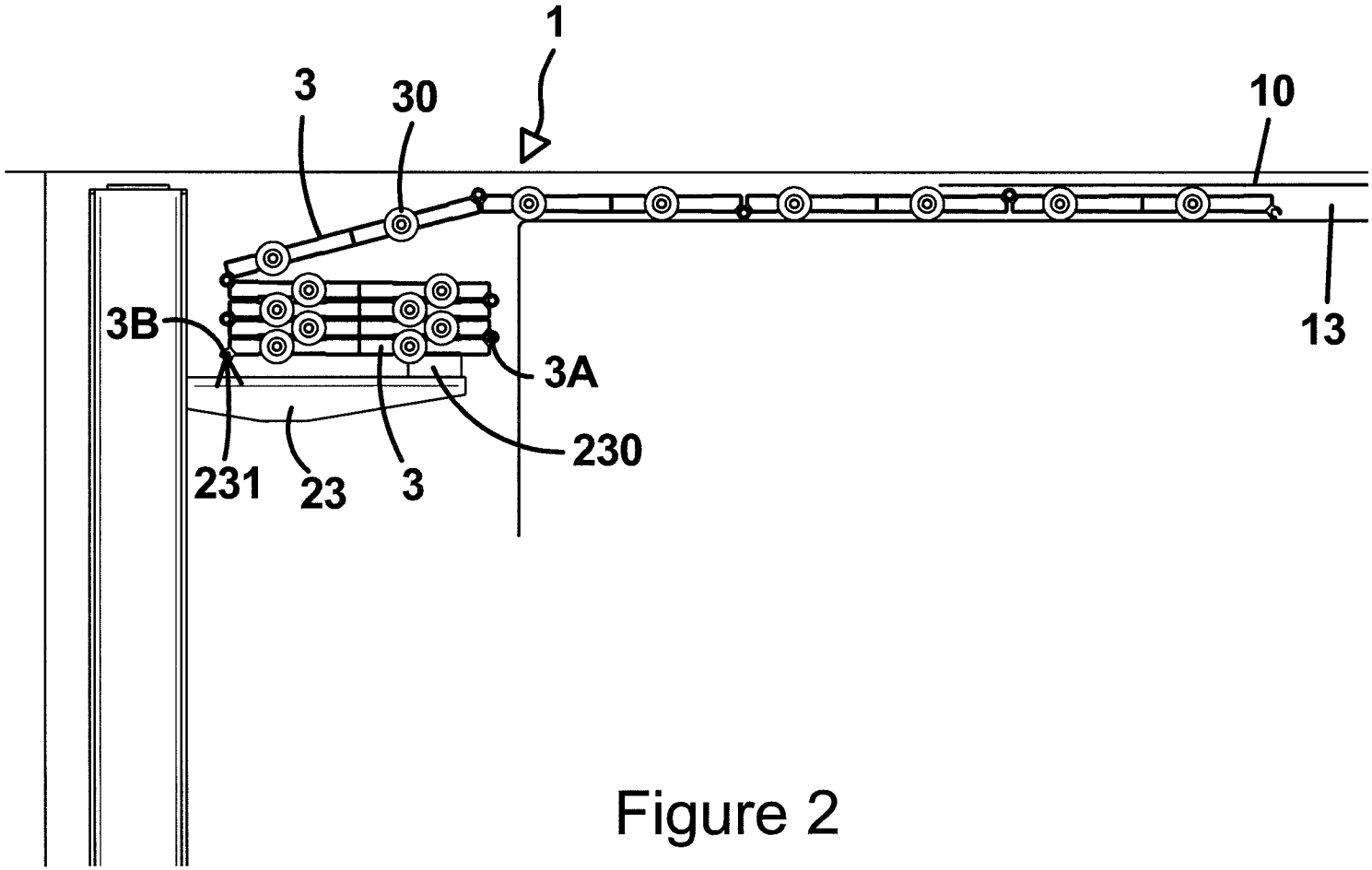
FIG. 2 is a diagrammatic longitudinal section view of the pit equipped with the closure device of FIG. 1 at the end of deployment of the panels that form a cover for closing off the opening in the pit.

As shown in FIGS. 1 to 3, said support tray 23 also has a support zone 230 that is spaced apart from the hinge means 231 of the support tray and that projects from the tray over a height substantially equal to the height to which the link means 231 equipping the support tray project, in such a manner as to maintain the panel 13 at the bottom of the stack of panels substantially parallel to the support tray 23, i.e. substantially horizontal.

The present invention is in no way limited to the embodiments described and shown, and the person skilled in the art can make any variant to them that lies within the spirit of the invention.

The invention claimed is:

1. A closure device to at least partially close a cavity that is open at a top thereof, said closure device comprising:

a plurality of panels configured to form a closure cover to at least partially close off said cavity and a cover support device configured to support said panels when said panels are deployed to form said closure, each panel of said plurality of panels having a link system linking to neighboring panels to enable said plurality of panels to go from a stacked configuration, in which the plurality of panels are superposed on one another in order to at least partially open up said opening in said cavity to a deployed configuration, in which at least one panel of the plurality of panels extends in alignment with other panels of the plurality of panels while bearing against said cover support device to form said closure cover, and vice versa; and an elastically deformable device configured to be compressed by said panels when said plurality of panels are in the stacked configuration, a resistance to deformation of said elastically deformable device being a function of a thickness and a weight of the panels such that a top of the plurality of panels in the stacked configuration, or a top of each panel of the plurality of panels, that exerts a bearing force on the elastically deformable device is situated at a substantially constant height both when said panels are in the stacked configuration and when at least some of the panels are in the deployed configuration when the weight of said at least some of the panels is supported by said cover support device.

2. The closure device according to claim 1, wherein said link system of the panels are configured to enable the panels to be folded concertina-fashion.

3. The device according to claim 1, wherein said link device of each panel that is adjacent another of the plurality of the panels comprises two hinge elements, one hinge element being disposed on a front edge of the panel and another of the hinge elements being disposed on a rear, opposite edge of said panel, and wherein the two hinge elements of said panel are distributed on either side of the center axis of the panel.

4. The closure device according to claim 1, further comprising a support tray configured to support the plurality of panels when said panels are in the stacked configuration, said support tray being coupled to the elastically deformable device wherein said support tray includes a support tray link system, including a hinge system that links together said support tray and one of the panels that forms the bottom panel of the stack of panels, and a support projection that projects from the tray at a height substantially equal to a height to which the tray system link device projects, to maintain the bottom panel substantially parallel to the support tray.

5. The closure device according to claim 1, wherein said plurality of panels are of substantially the same thickness and substantially the same weight from one panel to another.

6. The closure device according to claim 5, wherein the elastically deformable has a stiffness, expressed in deca Newtons (daN) per millimeter (mm), that is substantially equal to the weight of a panel, expressed in kilograms (kg), divided by its thickness, expressed in mm.

7. The closure device according to claim 1, wherein at least some of the panels are provided with a device configured slide on said cover support device provided on or in the vicinities of two opposite side walls of the cavity.

8. The closure device according to claim 7, wherein, on each side edge of each panel of said panels equipped with the slide device, said slide device comprises two slide members, at least one of the slide members being spaced from an end edge of the panel and another of the slide members being spaced a different distance from the end edge of the panel than a distance of the at least one slide member from the end edge of the panel.

9. The closure device according to claim 1, wherein at least some of the panels are provided with a device configured to roll to slide on said cover support device, such as rails, provided on or in the vicinities of two opposite side walls of the cavity.

10. The closure device according to claim 9, wherein, on each side edge of each panel of said panels equipped with the roll device, said roll device comprises two roll members, at least one of the roll members being spaced from an end edge of the panel and another of the roll members being spaced a different distance from the end edge of the panel than a distance of at least one roll member from the end edge of the panel.

11. The closure device according to claim 9, wherein the roll device is a rail device.

12. An installation comprising:

the cavity, the cavity being a pit; and a closure device according to claim 1, wherein said cover support means extend, at least partially substantially horizontally, on or in the vicinities of two opposite side walls of the cavity that define said top opening of the cavity.

13. The installation according to claim 12, wherein said cover support device comprises at least two rails fastened to or in the vicinities of said opposite side walls of the cavity, the at least two rails being parallel and in the vicinities of edges of said opposite side walls, while extending facing each other, at least some panels of the plurality of panels being configured to rest on the rails via side edges thereof when in the deployed configuration.

14. The installation according to claim 13, wherein said closure device is received at least partially inside the cavity.

15. The installation according to claim 14, wherein said closure device is received entirely inside the cavity.

16. The installation according to claim 14, wherein said closure device is received in the vicinity of an end wall of the cavity that interconnects said opposite side walls of the cavity.

* * * * *